US006347808B1

(12) United States Patent
Pennington

(10) Patent No.: US 6,347,808 B1
(45) Date of Patent: Feb. 19, 2002

(54) SKICUP ATTACHED TO A SKI BINDING

(76) Inventor: Daryl Pennington, 123 Blair Ave. #C, Rock Springs, WY (US) 82901

( * ) Notice: Subject to any disclaimer, the term of this patent is extended or adjusted under 35 U.S.C. 154(b) by 0 days.

(21) Appl. No.: 09/283,355

(22) Filed: Mar. 31, 1999

Related U.S. Application Data

(63) Continuation-in-part of application No. 09/066,169, filed on Apr. 24, 1998, now abandoned.

(51) Int. Cl.[7] ..... A63C 11/00
(52) U.S. Cl. ..... 280/809; 280/816
(58) Field of Search ..... 280/809, 816, 280/826, 842, 813, 602, 819, 824, 601, 607

(56) References Cited

U.S. PATENT DOCUMENTS

| | | | | | |
|---|---|---|---|---|---|
| 2,490,183 | A | * | 12/1949 | Wheeler | 280/809 |
| 3,246,907 | A | * | 4/1966 | Chisholm | 280/11.35 |
| 3,826,518 | A | * | 7/1974 | Hennig | 280/813 |
| 3,854,738 | A | * | 12/1974 | Fish | 280/11.13 |
| 3,999,773 | A | * | 12/1976 | Shuttleworth | 280/11.37 |
| 4,006,911 | A | * | 2/1977 | Kraus et al. | 280/809 |
| 4,008,908 | A | * | 2/1977 | Pierson | 280/636 |
| 4,227,708 | A | * | 10/1980 | Cote | 280/809 |
| 4,409,287 | A | * | 10/1983 | Harrison | 428/343 |
| 4,759,570 | A | * | 7/1988 | Dandy, III | 280/812 |
| 4,864,860 | A | * | 9/1989 | Manseth | 73/490 |
| 4,900,061 | A | * | 2/1990 | Kozma, Jr. | 280/813 |
| 5,480,175 | A | * | 1/1996 | Astier et al. | 280/607 |
| 5,803,479 | A | * | 9/1998 | Meyer et al. | 280/607 |
| 5,806,874 | A | * | 9/1998 | Sedlmair | 280/602 |

FOREIGN PATENT DOCUMENTS

| | | | | |
|---|---|---|---|---|
| EP | 0207302 | * | 1/1987 | 280/809 |
| WO | WO 93/01869 | * | 2/1993 | 280/809 |

* cited by examiner

*Primary Examiner*—Brian L. Johnson
*Assistant Examiner*—M B. Klebe

(57) ABSTRACT

A skicup for securing a ski pole tip while skiing, for the purpose of resting the skiers arms and reducing drag. The skicup attaches to the ski binding. The tip is primarily engaged by a cup-like cavity. One embodiment attaches only to the binding; however, if made of flexible material it can intermittently contact the ski. Another embodiment also attaches to the ski. Both embodiments have a protective flap to protect the ski from pole plants that miss the engagement surface.

18 Claims, 7 Drawing Sheets

SKICUP ATTACHED TO A SKI BINDING

BACKGROUND—CROSS-REFERENCE TO RELATED APPLICATIONS

This is a Continuation-In-Part of Ser. No. 09/066,169, filed Apr. 24, 1998, and now abandoned.

BACKGROUND—FIELD OF INVENTION

This invention relates to skis, specifically to ski accesories.

BACKGROUND—DESCRIPTION OF PRIOR ART

Skiers often encounter slopes of such low gradient that it is difficult to maintain much speed. On these slopes skiers either pole, skate or glide, often depending on if they are tired. Gliding is a common choice and it leaves them with nothing to do with their poles. It would be restful and relaxing to be able to place their pole tips on upper surface of the ski behind the binding. However, the pole would often fall off of the ski and repeatedly planting the pole on the ski would damage the ski. Sometimes gliding skiers will bring their poles to a horizontal position adjacent to their torso to reduce drag on such slopes. Placing the pole on the ski would put it behind the leg and might reduce drag. A device attached to the ski top behind the binding to receive the pole tip would remedy these problems. To my knowledge, heretofore such devices, i.e. skicups, have not been set forth in prior art.

The device shown in U.S. Pat. No. 4,759,570 to Dandy (1988) receives a pole tip much the same as does a skicup. However, its primary purpose is to transfer upper body weight to the skis through the poles. Other differences include the fact that the tip receiver was attached to the boot, not the ski, and the invention required more than just the receiver to work properly. A secondary purpose was to dispose of the poles while skiing down the slope to avoid injury to the skiers' thumb. While skiers would use their arms less, and drag is reduced, it appeared that neither was stated as an objective of this device. One drawback is the inability to disassemble the device quickly enough to use the poles to prevent a fall. Another is that it is designed to be assembled before skiing down a slope instead of while skiing. That prevents the skier from disposing of poles without stoping. That is unfortunate because frequently at the end of a ski run there is a slightly sloped runout to the lift on which it would be useful to dispose of ones' poles. If skiers had to stop to dispose of poles they would lose built up speed and lose more effort in regaining it than save in resting their arms and reducing drag. Frequently, speed cannot be regained on slopes such as these without using the poles, so the use of this device is precluded. This device is designed to dispose of the pole with a tip receiver and a body harness. The invention of this application disposes of the ski with a tip receiver alone or in combination with the skiers' hand. Further, the tip receiver is of small diameter and attached to the ski boot making it appear to be designed for pole placement at a standstill, not while moving. The small diameter requiring the user to look to plant the pole and the location immediately behind boot making it difficult to see the receiver.

Some ski bindings release the ski boot when a lever is depressed with a ski pole or boot, etc. These bindings often have a small cavity to help secure the ski pole tip while the lever is being depressed. These cavities are small and directly behind the boot. They are neither intended nor used to secure the pole tip while skiing. Their location and small size would make it difficult to plant the pole while skiing. Their small size would allow the pole to easily bounce out of the cavity. Their location would make it necessary to hold the arms farther outboard than would cavities located farther rearward. Resting the pole on the release lever might release the boot, especially if the lever were made longer to locate the cavity farther rearward.

BACKGROUND AND SUMMARY OF THE INVENTION

Accordingly, several objects of a skicup are:

(a) to provide a device whose shape and composition help to secure the pole tip on the ski:

(b) to provide a device whose shape and composition protect the ski from the pole tip;

(c) to provide a device whose location secures the pole in a position that facilitates pole planting and has reduced drag;

(d) to provide a device which allows a skier to rest his or her arms;

(e) to provide a device that accomplishes its objectives while interfering minimally with ski performance: and (f) to provide an easily attached and changed device.

Further objects and advantages are to provide a skicup that allows resting while stationary by leaning onto poles placed onto the skicup. This may be more common if used in conjunction with a seat slung between the pole handles. An advantage of some materials is that they do not damage a ski hitting the skicup. Some skiers may find advantages in using poles placed on skicups to augment the usual methods of controlling the skis. Some cups may be designed to carry a pole vertically while skiing or at rest with the purpose of freeing the hands. Some skicups add torsional or other dimensional strength to the ski and skicup assembly, which is another advantage.

BRIEF DESCRIPTION OF THE DRAWING FIGURES

FIG. 1 is a side view of the skicup 16 shown in FIG. 2, in use.

FIG. 2 is a broken out, perspective view of the ski 15, the rear binding 19, and the skicup 16.

Figure 6:
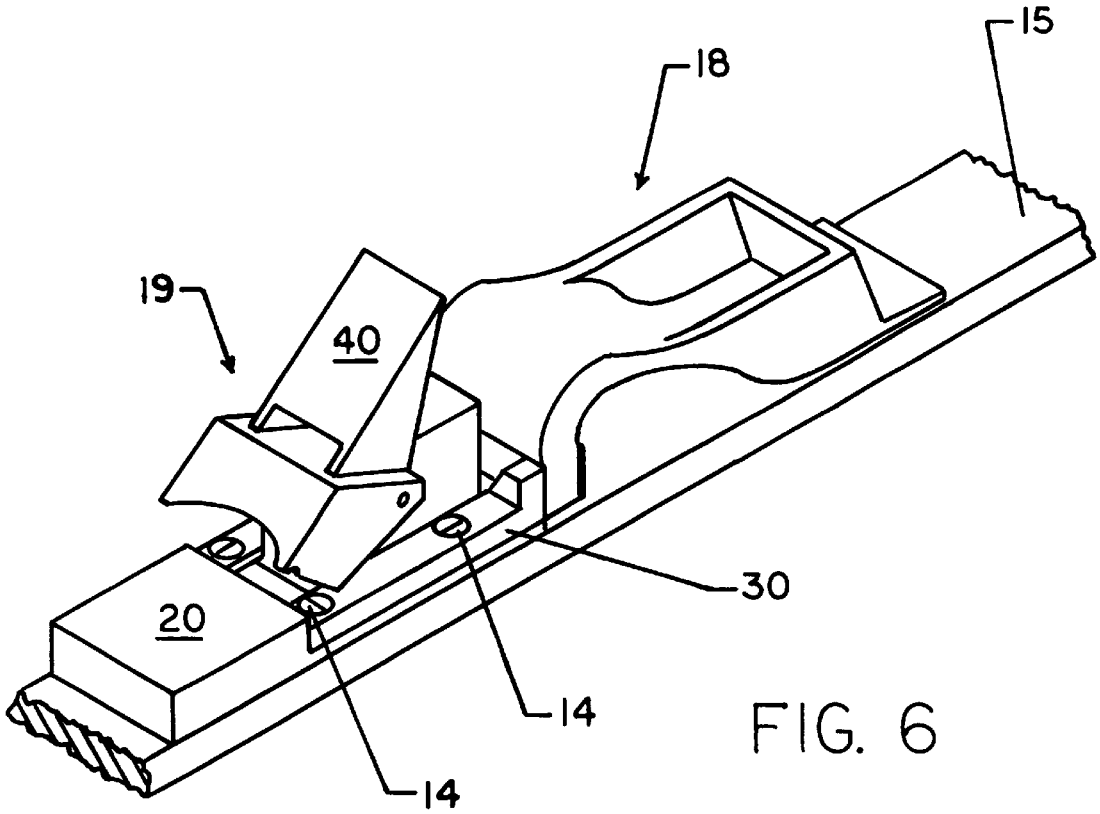

FIG. 6 is a broken out, perspective view of the ski 15, the rear binding 19, and the skicup 18.

Figure 7:
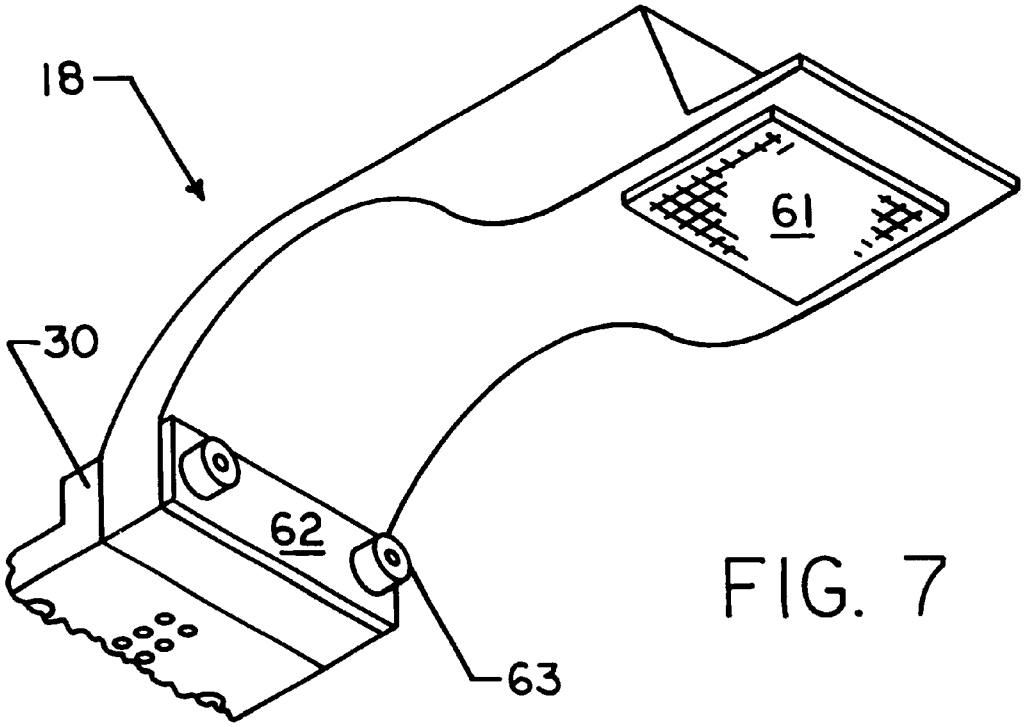

FIG. 7 is a broken out, perspective view of the underside of the skicup 18 and a portion of track plate 30.

DETAILED DESCRIPTION, FIGS. 1–7

Figure 1:
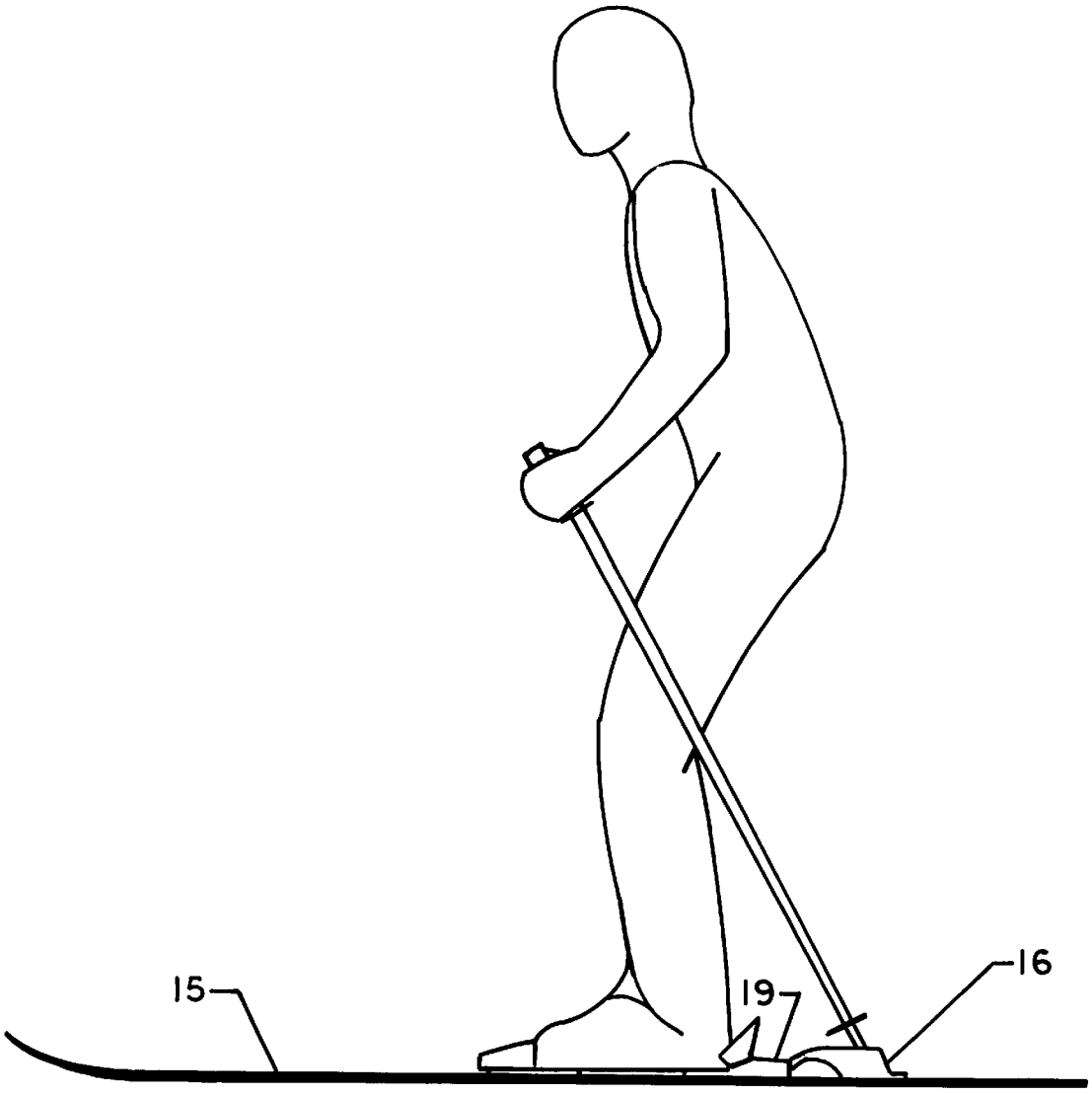

FIG. 1 is a side view of a skicup 16 in use. The skier, bindings 19, ski 15 and pole are readily identifiable. The skicup 16 is shown mounted on the left ski 15 behind the bindings. The skiers' ski pole tip is planted on skicup 16. For all figures, directions such as left, front and top are those of the skier. For example, left, front refers to the skier's left, front side. Longitudinal refers to the long dimension of the ski. Transverse is horizontal and perpendicular to longitudinal. Outboard is lateral and away from the skier.

Figure 2:
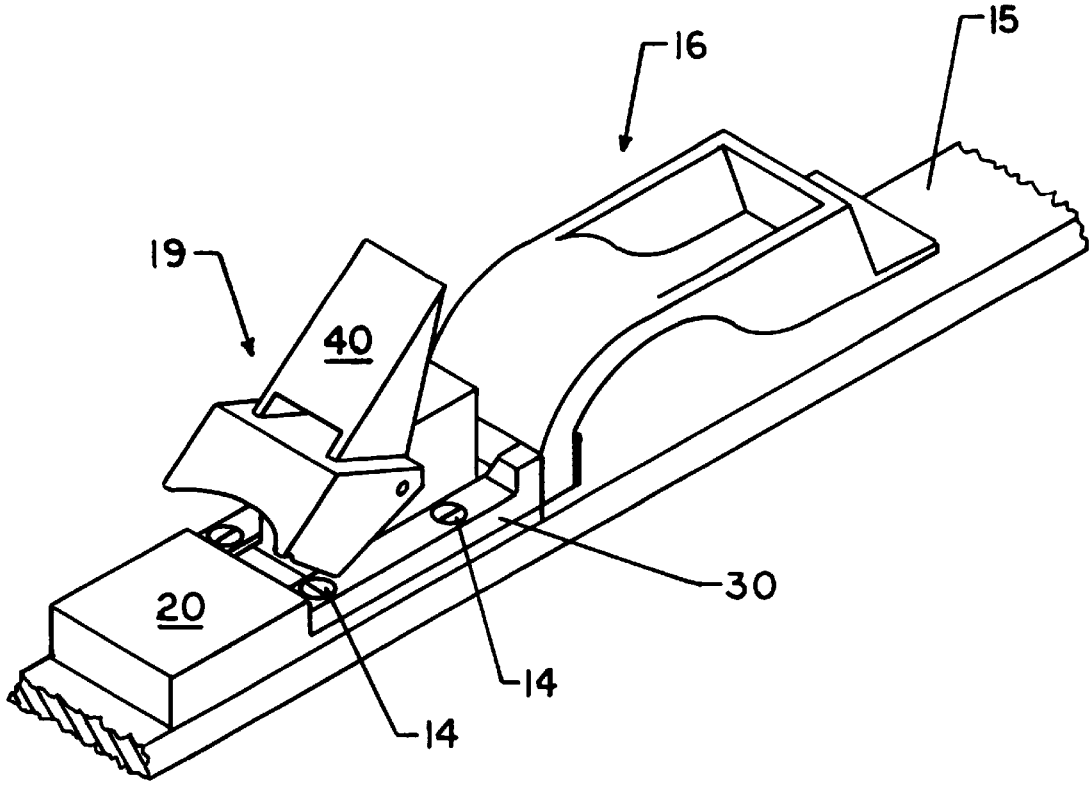

FIG. 2 is a broken out, perspective view of the front, left and top sides of the assembly of the ski 15, the rear ski binding 19 and the preferred embodiment, skicup 16. The ski binding is comprised of the baseplate 20, the track 30 and the heel lock 40. These are all parts commonly found on ski bindings. Four flat head bolts 14 pass through the track 30 and then through the baseplate 20 before threading into the ski 15. The four bolts 14 are in two pairs: each pair symetrically placed on either side of the binding 19. Three of four bolts 14 are shown. The skicup 16 is attached to the track 30. The skicup 16 is bolted onto the binding 19 (see FIG. 7). The skicup 16, being made of rubber type material, does not contact the ski 15 unless it is depressed by a ski pole or perhaps intermittently while skiing due to inertia. The binding 19 includes the baseplate 20, the track 30 and the heel lock 40.

Figure 3:
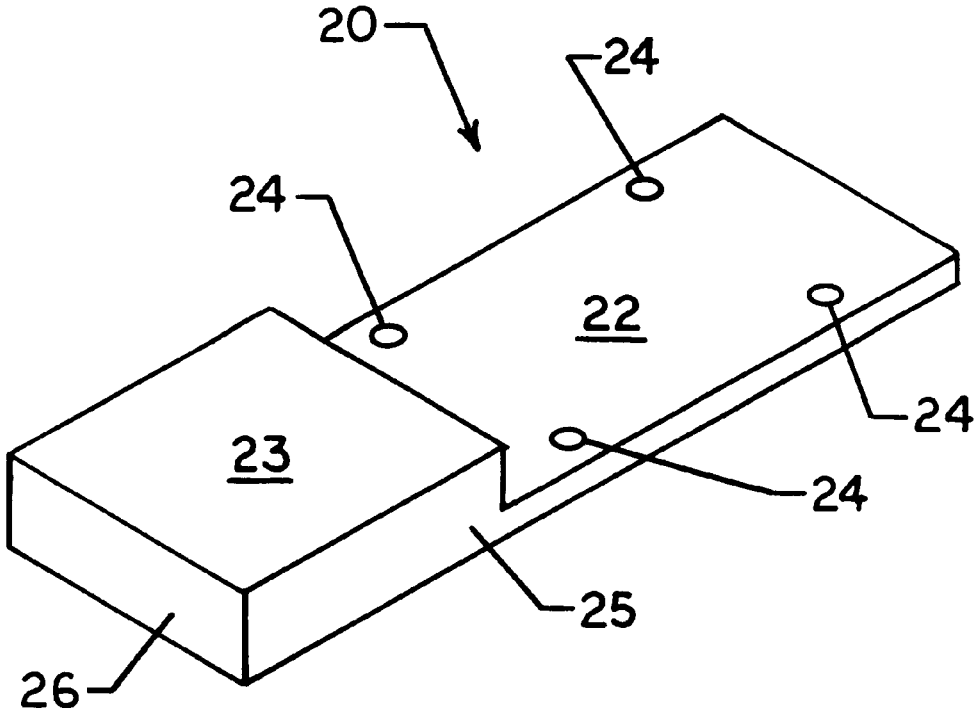
FIG. 3 is a perspective view of the baseplate 20 of the rear binding 19.

FIG. 3 is a perspective view of the front left and too sides of the baseplate 20. It is made of plastic. In top view it is rectangular. The top consists of two flat, horizontal surfaces 22 and 23 separated by a transverse, vertical surface. The two flat, horizontal surfaces are the track base surface 22 and the heel pad surface 23. Surface 23 is above and forward of surface 22. Both of surfaces 22 and 23 are approximately the same width as the bottom of baseplate 20 (not shown). The surface 23 is approximately square while surface 22 is approximately the length of the track plate 30. The bottom of the baseplate 20 is approximately flat, approximately horizontal and rectangular. The bottom of baseplate 20 contacts ski 15. The rear surface (not shown) is flat, vertical, and rectangular and is contiguous above and below with surface 22 and the bottom, respectively. Front surface 26 is flat vertical and rectangular and is contiguous above and below with surface 23 and the bottom respectively. Both sides 25 are flat, vertical and is bordered by surfaces 22, 23, 26, the vertical surface separating the surfaces 22 and 23, the bottom and the rear surfaces. The four through holes 24 in surface 22 are vertical and coaxial with holes 38 in the track plate 30.

Figure 4:
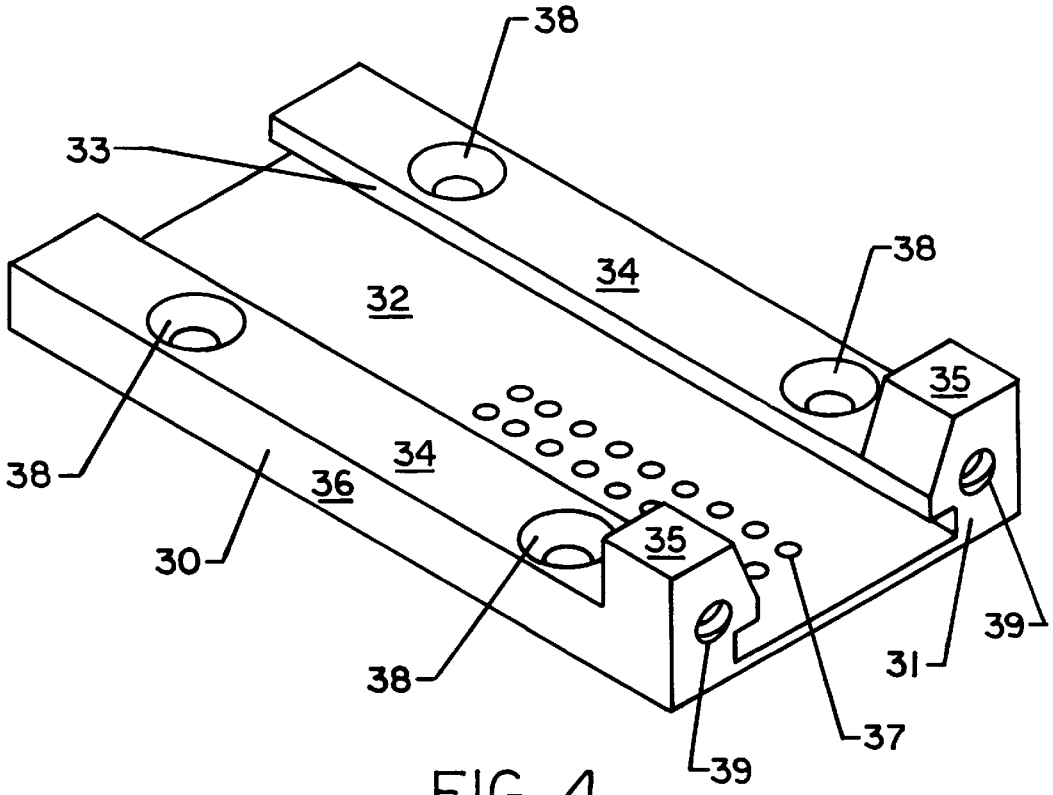
FIG. 4 is a perspective view of the track plate 30 of the rear binding 19.

FIG. 4 is a perspective view of the rear, left and top sides of track plate 30. Track plate 30 is made of steel. Its top view is rectangular and approximately the same size and shape as the baseplate surface 22, to which the bottom surface of plate 30 mates. The plate tops 34 are upward facing, horizontal surfaces forming the top of plate 30 from its front rearward to the flanges 35. The tops 34 are contiguous inwardly with the track and are contiguous laterally with the plate sides 36. A prominent feature of plate 30 is the inverted. "T" shaped track. It allows the inverted "T" shaped base of heel lock 40 to be mounted on plate 30 and still be moveable longitudinally. The track is a through track, spaning the length of plate 30. The bottom of the track is formed by a flat, horizontal, upward facing surface 32. The centerplane will be defined as a vertical, longitudinal plane bisecting surface 32. There are two symetrical, end-to-end, longitudinal projections that extend horizontally and inwardly toward the centerplane of the track and overlap surface 32 from both sides, to retain the "T" shaped base of heel lock 40. The two slide retainer inward surfaces 33 are the surfaces that inwardly cap the end-to-end, longitudinal projections. Surfaces 33 are flat, rectangular, vertical, short in height and long longitudinally. Surfaces 33 are contiguous on their upward edge with tops 34 and the sloping, inward side of flange 35. Rearward of, and contiguous with the tops 34 are the two flanges 35 which are somewhat cubic, upward projections above the plate tops 34. The inner side of each flange 35 slopes outward, away from the track centerplane. Flange 35 slopes away from heel lock 40 to allow it ease of movement. The other three sides of flange 35 are vertical and perpendicular to their adjoining sides. The top of flange 35 is horizontal and flat. Flange surface 31 forms the vertical, transverse, rear surface of each flange 35 and track plate 30. Surface 31 has a roughly rectangular exterior shape which is embayed from the top by the track. The side 36 is longitudinal, vertical, flat and somewhat L-shaped, the shorter, vertical arm being the outer side of flange 35. The front is transverse, vertical, flat and has a rectangular shape except for the embayment from its top made by the track.

There are 18 vertical, through holes 37 in surface 32; these engage protrusions on the lock 19. They are arranged symetrically on opposite sides of the track centerplane in nine evenly spaced pairs. The rearmost pair of holes 37 is approximately as rearward as the front of the flanges 35. There are four vertical, countersunk, though holes 38 in the tops 34; these are mounting holes. The bolts 14 pass through the holes 38 and then the holes 24 before threading into the ski 15. There are two pairs of two holes 38 symetrical about the track centerplane. There are two horizontal, longitudinal, threaded holes 39 in surface 31. The holes 39 are in the lower middle of the flanges 35, about the height of tops 34. The holes 39 are coaxial with the holes 52 in the skicup 16.

Figure 5:
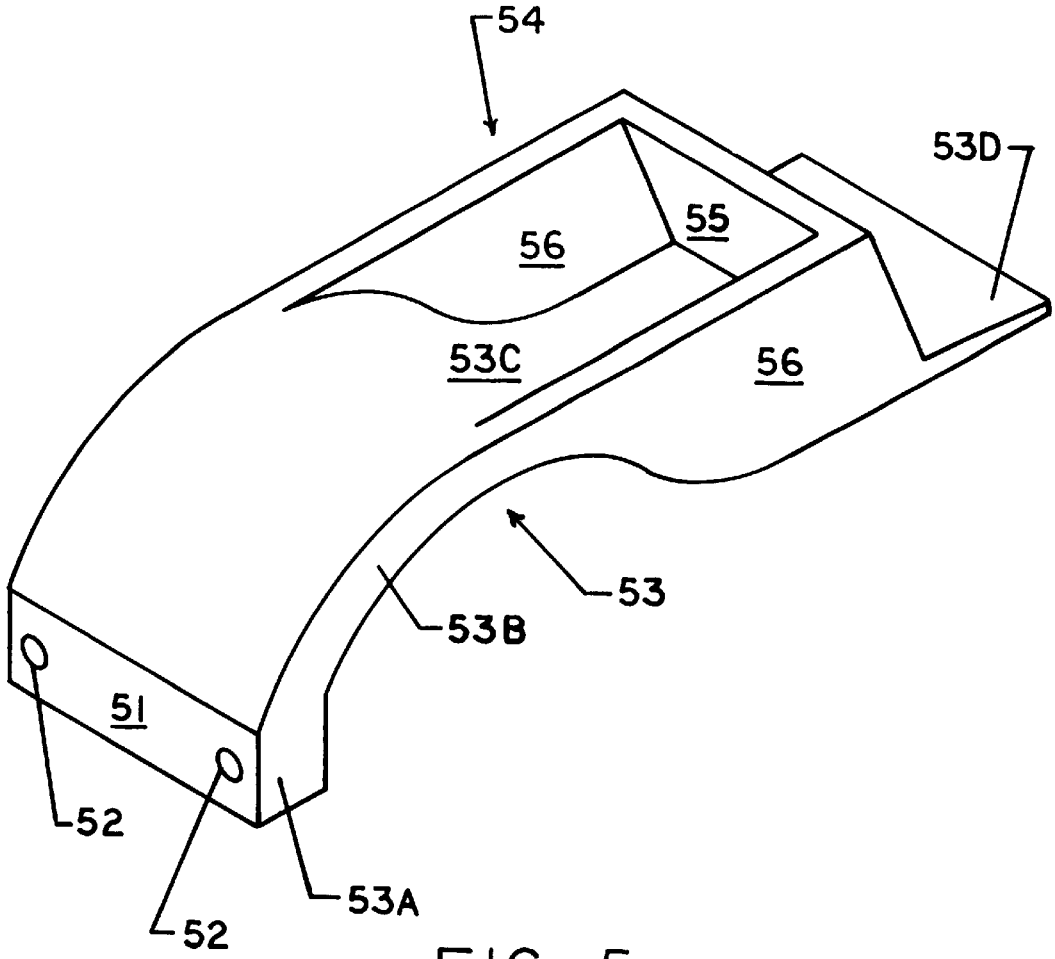
FIG. 5 is a perspective view of frame 53 and wall 55, 56.

FIG. 5 is a perspective view of the front, left and top sides of the rubber portion of skicup 16. It is made of rubber type material. The front surface 51 is flat, vertical and transverse. The surface 51 has two horizontal, longitudinal through holes 52. Surface 51 is the front of the support base 53A. The rear surface of the support base 53A is a surface identical in shape to and parallel to surface 51, which is translated horizontally rearward and faces rearward. The frame 53 is shaped like a plank curved perpendicular to its length. The frame 53 maintains constant transverse width from front to rear and tapers in a direction perpendicular to its top and bottom surfaces from front to rear. The frame 53 forms the entire bottomside and most of the topside of the skicup 16. The support base 53A is that portion of frame 53 that is rearward of surface 51. The base 53A has a flat, horizontal bottom surface. Upward of the support base 53A extends the fillet 53B portion of the frame 53. The fillet 53B is transverse and curves from approximately vertical at the support base 53A to approximately horizontal at the front of the cup bottom 53C portion of frame 53 which is at the frontmost points of the side walls 56. Extending farther rearward, the bottom 53C curves downward and forms the bottom of the cup 54. After curving downward and still forming the bottom of the cup 54, the bottom 53C curves into an approximately horizontal orientation. Continuing horizontally rearward, the bottom 53C extends rearward to the rear edge of the rear wall 55. Extending rearward of bottom 53C is a protective flap 53D. The flap 53D extends approximately horizontally rearward. The cup 54 is formed by three walls 55 and 56 and the bottom 53C which forms both the bottom of the cup 54 and its front wall. The three walls 55 and 56 are the rear wall 55 and two identical side walls 56. The side walls 56 are flat. platelike, vertical, longitudinal and extend upward from the bottom 53C to a height about level with the highest points of the frame 53 and the height of the rear wall 55. The exterior sides of the walls 56 are flush and coplaner with the flat, vertical and longitudinal sides of frame 53. The rear wall 55 extends upward and forward from the bottom 53C and is flat, platelike and transverse. The tops of the walls 55 and 56 are flat, approximately horizontal, and approximately coplaner surfaces. The cup 54 is the cavity formed by the walls 55 and 56 and the bottom 53C.

The basal surface of a skicup is that surface which interfaces with a ski or a ski binding. Therefore, the basal surface of this embodiment is the surface 51 and the underside of both the bottom 53C and the flap 53D. How a skicup and a ski interface depends on the particulars of the skicup and ski. In this case the basal surface is mechanically clamped by bolts 63 (see FIG. 7) against the ski binding 19, and and another portion of the basal surface intermittently contacts the ski 15 beneath the bottom 53C and the flap 53D due to inertia or the force from the ski pole tip. Skicups that are made in the same process as the ski binding might have material, such as fibers or metal, that is continuous from what is clearly the ski binding or ski to what is clearly the skicup. In such cases the basal surface would be between what is mostly the skicup and what is mostly the ski binding. However, its exact location would have to be decided on particulars of that configuration of skicup and ski binding or ski.

The engagement surface of a skicup is those surfaces that engage the pole tip in the process of securing the tip such that the pole may be rested. Thus the engagement surface includes surfaces on or in which the pole tip is secured and surfaces which help guide the pole tip to surfaces which will secure it and surfaces which help maintain the tip on or in a securing surface. The engagement surface of this embodiment includes the cup 54 and the top surfaces of the walls 55 and 56 and the topside of the fillet 53B and the top of flap 53D. The flap 53D is designed to protect the ski 15 from errant pole plants but it could conceivably secure the tip long enough to qualify as a portion of the engagement surface. The body of the skicup is simply the solid object having those surfaces and features listed as those of the skicup. The body of this skicup 16 is the frame 53 and walls 55 and 56 and the plate 62 and the bolts 63.

FIG. 6 is a perspective view of the front, left and top sides of the assembly of the ski 15, the rear ski binding 19 and skicup 18. The skicup 18 differs from skicup 16 only in the addition of the patch 61 of loop and hook material that secures the underside of skicup 18 to the topside of ski 15. See FIG. 7. Thereby, the skicup 18 is attached to the ski 15 approximately beneath the cup 54 and the flap 53D, in addition to being attached to the binding 19. The basal surface of skicup 18 is the surface 51 and the patch 61. This attachment deforms the skicup 18 slightly; however skicup 18 before being flexed downward and secured to the ski 15 is identical to skicup 16 except for the patch 61.

FIG. 7 is a broken out perspective view of the rear, left and bottom sides of the skicup 18 and a portion of track plate 30. The skicup 18 differs from skicup 16 only in the addition of a loop and hook material patch 61 on the underside of frame 53. The patch 61 comprises an approximately square patch of hook material interlocked to a similarly shaped and sized patch of loop material. The loop material is adhesively fixed to the underside of the bottom 53C and the flap 53D. In assembly adhesive fixes the hook material to ski 15. The plate 62 is a plain, flat, steel plate, approximately the same rectangular size in rear view and as the rear of the base support 53A. The plate 62 has two through holes that are coaxial with the holes 39 in plate 30, which allows two socket head bolts 63 to pass through and clamp the plate 62 and the support base onto the binding 19 at track 30.

The bodies of the two skicups 16 and 18 are identical except for the addition of the patch 61. The basal surface of skicup 18 is the surface 51 and the bottom of the patch 61, or more accurately the bottom of the adhesive that fixes the bottom of the patch 61 to ski 15. Except for elastic deformation, the engagement surface of the skicup 18 is identical to that of the skicup 16.

OPERATION, FIGS. 1–7

The four bolts 14 are passed through track 30 and baseplate 20 and then threaded into the ski 15. Heel lock 40 is then slid into the T-track of track 30. The two bolts 63 are then passed through plate 62 and base support 53A and then threaded into the holes 39. That completes the assembly shown in FIG. 2. The assembly shown in FIG. 6 additionally requires the fixing of the hook portion of the patch 61 to the ski 15 prior to bolting the skicup 18 to track 30. After the skicup is bolted to the track 30 the rear of the skicup 18 is depressed until the hook and loop fastener interlocks and becomes secured.

In the embodiments shown, the surfaces that secure the ski pole tip are characterized by having at least some forward facing area as well as some approximately horizontal or rearward and upward facing area. The skicups 16 and 18 have the rear walls 55 and the frames 53. Thus, both of the embodiments shown have at least one two dimensional upwards and forwards facing concavity for securing the pole tip. Here, a two dimensional forward and upward facing concavity simply means that in transverse view with the walls 56 removed, the bottom 53C and wall 55 form a forward and upward facing concavity. Put another way, the cup 54 faces upward because the top of the cup 54 is a set of horizontal surfaces. It might be useful to face forwards and outboard as well as upwards.

In operation, the forward facing surface (the front of the wall 55) serves as a mechanical stop to prevent the tip from moving farther rearward while the horizontal surface or component stops downward motion. Similarly, side walls 56 stop transverse motion. As a minimum, a single flat surface approximately perpendicular to the ski pole length or sufficiently soft to form a small concavity would prevent motion of the tip. However, these require force to be applied along the pole axis continuously. Concave shapes can secure the tip with little or no force applied and if overhanging, can help secure the tip against upward movement.

To use a skicup, the skier plants the ski pole on or in the engagement surface of the skicup. The pole tip may land on a surface and then be guided to a resting point and stay there. Sometimes the skier may have to look to be able to plant the pole accurately. With experience, the skier may be able to plant the pole without looking back. Some skicups may require an additional force to push the pole tip into constricted openings in the engagement surface. Removal of the pole is the reverse of placement. The use of a skicup that is mounted forward of the bindings is possible but likely hazardous.

Snow and ice accretion on and beneath the skicup 16 is impeded by the whole frame 53 and cup 54 flexing and even bouncing on the topside of the ski 15. To aleviate the noise and abrasion of that bouncing and/or form a transient structural connection a part may be added in the location of patch 61. Such a noise and abrasion reducer might take the form of a patch of soft, furry material or carpet-like material or a piece of soft foam rubber or a sprung-plate hinged near the binding that constantly contacts the ski 15. If consumers prefer the cup to hold the pole tip more solidly, yet not affect ski performance, then devices such as flexible rubber or plastic plates with longitudinal, mating grooves could be adhesively affixed to the skicup 16 and the ski 15. Alternately, skicup 16 could be designed such that the frame 53 rests on and exerts force on the topside of ski 15. The addition of structures that lap over the sides of the ski 15 would help stabilize the skicup 16 against lateral forces. Mating patches of material that restrict movement in all horizontal directions could also be used in place of patch 61.

The skicup 16 being made of flexible, resilient, durable material can withstand pole plants with little or no damage and shed ice and snow fairly easily. The low shape reduces snow drag. The attachment method allows the consumer to choose from and attach a wide variety of skicups. Further, the consumer can change skicups without difficulty. These attachment configurations also minimize a skicups' affect on ski 15 performance. The embodiment with attachment only to the rear binding 19 appears to have no affect on ski performance, except for the mass of the skicup 16 and its attachment parts. The fillet 53B can help guide the tip into the cup 54 and protect the ski 15 from pole plants. The skicup 18 can be made lighter than the skicup 16 because it has more attachment points. The skicup 18 may also resist force from the side better than the skicup 16.

SUMMARY, RAMIFICATIONS AND SCOPE

This device has advantages in resting the ski pole and possibly in adding some control to the ski. Skicups might be used to form a seat if a sling seat were slung between the poles. If the cup were made deep and very narrow then skiers could dispose of the poles in the skicup and use their hands freely.

The track plate 30 is similar to binding tracks which are made by stamping or forging a piece of plate stock. This is an inexpensive method of production and might be used to form the holes 39. The metal could be rolled into hollow cylinders coaxial with holes 39. The cylindrical holes could be threaded or rolled around threaded parts or have a stud fixed into them or simply be holes through which a nutted bolt passes. The stamping process could leave vertical transverse, upturned flanges that could be threaded or used with a nutted bolt or have a nut fixed onto them. Studs or holed parts could be fixed to prior art tracks as a method of attaching a skicup. Vertical holes in the binding could be useful for attaching skicups. A skicup could attach to a binding by sliding and locking into the track of it. Plate 30 could be cast in a aluminum, strong plastic or formed of fiber reinforced plastic.

The fastener consisting of hook and loop material could be accomplished by use of: adhesive, bolt(s) passing into the ski, a knoblike protrusion retained by a keyholed slot in a plate, a T-shaped slide in a track that is open ended at its front and closed at its rear, providing a stop against rearward force, a snaplike fastener, or staples. Multiple fasteners could be used or a solitary fastener fixed on the outboard side of the ski could counter force directed inward and causing a torque on the cup 54. The bolts 63 could be replaced by the locking cams found on furniture, or cottered pins or adhesives or hook material covered arms that would be secured by pile material fixed about where tops 34 are located or slotted ratchet teeth formed in the base support 53A that catch on a sprung pawl.

Frame 53 could be made of: metal, hard or soft plastic, fiber reinforced plastic, multi-layered organic polymers such as found on some shoes in which a soft, light layer is protected by a hard layer, or combinations of the preceding materials. In particular, the topside and bottomside of frame 53 could be made of more durable rubber while the medial layer was composed of soft foam rubber. If the frame 53 is made of a nearly rigid material then it will not contact the ski or will do so only when considerable force is applied with the ski pole. The flap 53D could extend around to the side of frame 53 to protect the side of the ski 15. That lateral extension could bend downward until parallel to the ski 15 side.

The skicup 16 could be made higher and wider and/or with a plurality of cavities like cup 54 to make pole planting easier or to reduce snow drag. Cup 54 could have one or more constricted cavities that tend to grip the pole tip. The cavities could be belled to interlock with a mating ski pole tip. Increasing the overhang of the rear wall 55 could reduce the liklihood of the tip being ejected from the cup 54. The friction of some materials such as rubber or carpet might also help retain the tip. Shock absorbing and tip entangling rubber loops or spines such as found on Koosh brand toys could be used for secureing a pole tip. Koosh is a trademark of Oddzon, Inc. of Campbell, Calif. Carpet-type material could be used on engagement surfaces.

The skicup 15 is somewhat open as a compromise between the goals of ease of placement, ease of removal and stability against bouncing out of the skicup. If there is need to remove the poles quickly an open trough will not bind them in the trough and make them more difficult to remove. The skicup is designed with a low profile, in part, to reduce snow drag. This may be especially important while turning and in unpacked snow.

This is such a new device that there is a broad range of ramifications of which only a few can be covered in this application. Some other ramifications are described in the Disclosure Documents previously deposited in the Disclosure Document Program. Thus the scope of the invention should be determined by the appended claims and their legal equivalents, rather than by the examples given.

What is claimed is:

1. A ski binding, ski pole, and skicup comprising:

(a) said ski binding, and;

(b) said ski pole, and, (c) said skicup, wherein a ski pole tip engagement means for engaging a ski pole tip of said ski pole is located on said skicup, wherein said ski pole tip is engaged by said ski pole tip engagement means, wherein a basal surface means for interfacing with said ski binding is located on said skicup, wherein a ski binding attachment means for attaching said skicup to said ski binding is located on said skicup, wherein said skicup is attached to said ski binding by said ski binding attachment means on the rear side of a heel release portion of said ski binding, wherein said skicup is located generally behind said ski binding, wherein said skicup is located entirely behind a toe release portion of said ski binding, whereby a skier may rest his or her arms while skiing.

2. The ski binding, ski pole, and skicup of claim 1, wherein said ski pole tip engagement means includes a hole, wherein said hole has a bottom, wherein said hole is at least as wide as it is deep.

3. The ski binding, ski pole, and skicup of claim 1, wherein said skicup is located entirely rearward of said ski binding.

4. The ski binding, ski pole, and skicup of claim 1, further including a ski, wherein said skicup has a attachment means for attaching said skicup to said ski, wherein said skicup is attached to said ski.

5. The ski binding, ski pole, and skicup of claim 1, wherein said skicup is composed entirely of rubber like material except for two metal bolts and a metal plate.

6. The ski binding, ski pole, and skicup of claim 1, wherein said ski pole tip engagement means is on a structure made of rubber like material.

7. A ski, ski binding, ski pole, and skicup comprising:

(a) said ski, and;

(b) said ski binding, wherein said ski binding is attached to said ski, and;

(c) said ski pole, and;

(d) said skicup, wherein a ski pole tip engagement means for engaging a ski pole tip of said ski pole is located on said skicup, wherein said ski pole tip is engaged by said ski pole tip engagement means, wherein a basal surface means for interfacing with said ski binding is located on said skicup, wherein a ski binding attachment means for attaching said skicup to said ski binding is located on said skicup, wherein said skicup is attached to said ski binding by said ski binding attachment means on the rear side of a heel release portion of said ski binding, wherein said skicup is located generally behind said ski binding and entirely forward of the rearmost point of said ski, wherein said skicup is located entirely behind a toe release portion of said ski binding, whereby a skier may rest his or her arms while skiing.

8. The ski, ski binding, ski pole, and skicup of claim 7, wherein said skicup is attached to said ski.

9. The ski, ski binding, ski pole, and skicup of claim 7, wherein said skicup is composed entirely of rubber like material except for two metal bolts and a metal plate.

10. The ski, ski binding, ski pole, and skicup of claim 7, wherein said ski pole tip contacts said skicup within a hole in said skicup, wherein said hole has a bottom.

11. The ski, ski binding, ski pole, and skicup of claim 7, wherein said skicup is located entirely above said ski.

12. A ski binding, ski pole, and skicup, comprising:

(a) said ski pole, and;

(b) said ski binding, and;

(c) said skicup, wherein said ski pole tip is engaged by a hole in said skicup, wherein the maximum width of said hole is at least as great as its depth, wherein said hole has a bottom, wherein a basal surface means for interfacing with said ski binding is located on said skicup, wherein a ski binding attachment means for attaching said skicup to said ski binding is located on said skicup, wherein said skicup is attached to said ski binding by said ski binding attachment means on the rear side of a heel release portion of said ski binding, wherein said skicup is located generally behind said ski binding, wherein said skicup is located entirely behind a toe release portion of said ski binding, whereby a skier may rest his or her arms while skiing.

13. The ski binding, ski pole, and skicup of claim 12, wherein said hole faces approximately upward.

14. The ski binding, ski pole, and skicup of claim 12, wherein said skicup is composed entirely of rubber like material except for two metal bolts and a metal plate.

15. The ski binding, ski pole, and skicup of claim 12, further including a ski attachment means for attaching said skicup to a ski.

16. The ski binding, ski pole, and skicup of claim 12, further including a protective flap extending approximately horizontally rearward from said skicup.

17. The ski binding, ski pole, and skicup of claim 12, wherein said ski binding has a track within which a heel release mechanism of said ski binding may be moved to be located at multiple locations, wherein two skicup attachment holes are located on said track, wherein the centerlines of said two skicup attachment holes are parallel to the axis of motion along which said heel release mechanism can move within said track, wherein said two skicup attachment holes are disposed on either side of said track.

18. The ski binding, ski pole, and skicup of claim 17, wherein two bolts pass through said skicup and thread into said two skicup attachment holes, whereby said skicup is attached to said ski binding.

* * * * *